United States Patent [19]

Matsumoto et al.

[11] Patent Number: 4,521,651

[45] Date of Patent: Jun. 4, 1985

[54] DIAPHRAGM APPARATUS HAVING A MAGNETICALLY IMPARTED HYSTERESIS CHARACTERISTIC

[75] Inventors: Akio Matsumoto; Mitsuyoshi Yokota, both of Himeji, Japan

[73] Assignee: Mitsubishi Denki Kabushiki Kaisha, Tokyo, Japan

[21] Appl. No.: 534,506

[22] Filed: Sep. 21, 1983

[30] Foreign Application Priority Data

Oct. 12, 1982 [JP] Japan ..... 57-155638[U]

[51] Int. Cl.[3] ..... H01H 35/40

[52] U.S. Cl. ..... 200/83 R; 200/83 L; 200/83 N

[58] Field of Search ..... 200/83 A, 83 L, 83 Q, 200/83 R, 83 T, 83 N

[56] References Cited

U.S. PATENT DOCUMENTS 2,628,296 2/1953 Dillman ..... 200/83 L X
3,681,721 8/1972 Wessel et al. ..... 200/83 T X

FOREIGN PATENT DOCUMENTS 2720875 11/1978 Fed. Rep. of Germany ... 200/83 N
895748 5/1962 United Kingdom ..... 200/83 L

*Primary Examiner*—A. D. Pellinen
*Assistant Examiner*—Susan Steward
*Attorney, Agent, or Firm*—Lowe King Price & Becker

[57] ABSTRACT

In a diaphragm apparatus, such as a switch having a diaphragm to be driven by a pressure difference between two spaces, an iron disk is fixed to the center of the diaphragm and a ring-shaped permanent magnet is fixed to an inside wall of a case to magnetically attract the iron disk. This provides hysteresis in the force-motion characteristic of the diaphragm to reduce hunting.

13 Claims, 6 Drawing Figures

DIAPHRAGM APPARATUS HAVING A MAGNETICALLY IMPARTED HYSTERESIS CHARACTERISTIC

BACKGROUND OF THE INVENTION

1. Field of the Invention

The present invention relates generally to an improvement in a diaphragm apparatus for use as a pressure-responsive switch or the like, and more particularly to a diaphragm apparatus having a magnetically induced hysteresis characteristic to reduce chattering.

2. Description of the Prior Art

A typical conventional diaphragm apparatus for use as a pressure-responsive switch or the like has a structure and operation as described hereafter with reference to FIG. 1, which is a sectional side view of the conventional diaphragm apparatus. The diaphragm apparatus has a diaphragm 4 in a case 1. When pressure in a vacuum tank T rises above a predetermined level, that is, when a pressure difference between a first partitioned space A connected to the vacuum tank T and a second partitioned space B exposed to open space air is smaller than a predetermined amount, the diaphragm 4 is biased to the right in FIG. 1 by a compressed coil spring 6. The spring 6 is held between a receiving washer 7 on an inside wall and a spring receiving seat 51 fixed to the center of the diaphragm 4. A moving contact 5 is thereby caused to contact another contact 3 fixed to the center of a plastic cap 2 of the case 1. As a result, an electric circuit of a motor M of a vacuum pump P is closed thereby operating the vacuum pump. Thereafter, the pressure of the vacuum tank reaches a predetermined low pressure, and the pressure difference between the first partitioned space A and a second partitioned space B becomes larger than a predetermined amount. The diaphragm 4 is then biased to the left in FIG. 1 as a result of the pressure difference now overcoming the force of the compression spring 6. The moving contact 5 separates from the fixed contact 3, deenergizing the motor M of the vacuum pump P.

In such a conventional diaphragm apparatus, since the diaphragm 4 is driven by the pressure difference between the first partitioned space A and the second partitioned space B, a first pressure difference to make the moving contact 5 contact the fixed contact 3 and a second pressure difference to make the moving contact 5 separate from the fixed contact 3 are substantially the same. Thus, the closing and opening of the motor circuit occur too frequently, responding, in practice, to every slight change of pressure in the vacuum tank T. This induces chattering of the diaphragm and moving contact 5, thereby shortening the lives of the moving contact 5, fixed contact 3 and motor M, and inducing operating problems within the related system.

SUMMARY OF THE INVENTION

Therefore, a primary purpose of the present invention is to provide an improved diaphragm apparatus wherein diaphragm and moving contact chatter is prevented by providing a certain level difference between a first pressure (difference) required for imparting motion of the diaphragm in a first direction within a predetermined range of motion and a second pressure (difference) required for imparting motion of the diaphragm in a second direction opposite the first direction within the predetermined range of motion.

A diaphragm apparatus in accordance with the present invention comprises a case which defines a space and has a first port and a second port, a diaphragm which is air-tightly mounted inside the case, establishing two partitioned spaces, the first partitioned space being connected to the first port and the second partitioned space being connected to the second port, biasing means for biasing the diaphragm to a predetermined direction, first magnetic means movable with the diaphragm, and second magnetic means fixed with respect to the case, the first magnetic means and the second magnetic means being mutually related to each other through magnetic forces, thereby to establish hysteresis in a pressure-position characteristic of the diaphragm for a predetermined range of positions of the diaphragm.

DETAILED DESCRIPTION OF A PREFERRED EMBODIMENT

The structure of a preferred embodiment of a diaphragm apparatus embodying the present invention is described in detail with reference to FIG. 2–FIG. 6.

Figure 1:
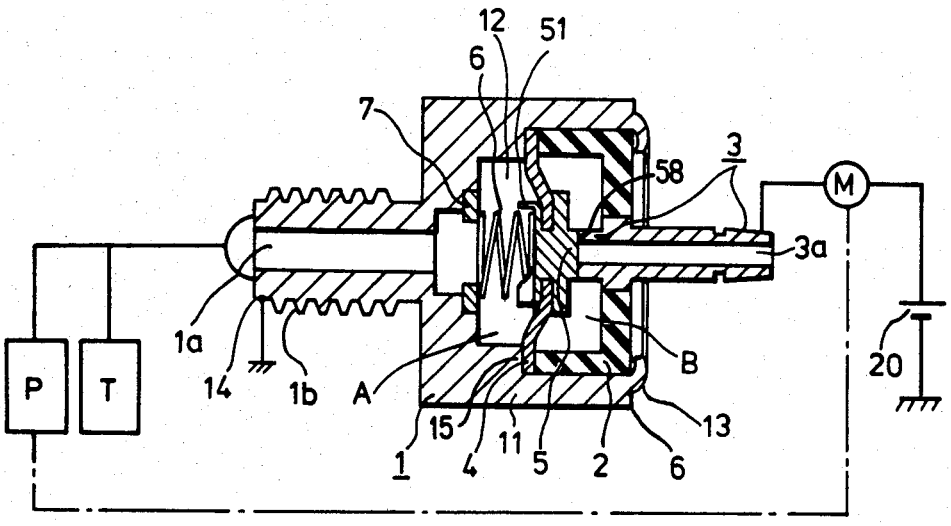
FIG.1 (Prior Art)
FIG. 1 is a cross-sectional side view of a conventional diaphragm apparatus and applied circuitry, used as a pressure-responsive switch of a vacuum system.
Figure 2:
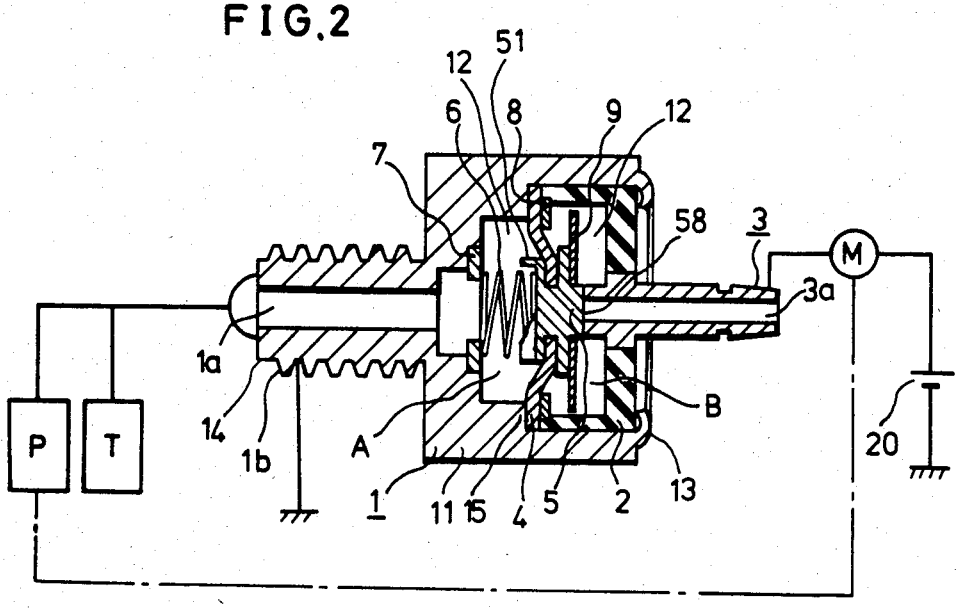
FIG. 2 is a cross-sectional side view of an embodiment of a diaphragm apparatus embodying the present invention in one state of operation, used as a pressure-responsive switch of a vacuum system.

As shown in FIG. 2, a case 1 made of a metal, for instance, of a wrought steel or alloy, is configured substantially in a cylinder-shape having a principal part 11 defining a hollow space 12 and an open end 13. The outer face of the case 1 is preferably formed in a hexagonal prism shape so as to be handled with an ordinary hexagonal spanner. At the other end of the case 1, a coupling part 14 of a tubular-shape having a screw thread **1*b* on the outer face thereof is formed. A through-hole or a port 1*a*, which leads to an inside space 12 of the case 1 and serves as an air outlet port, is formed in the coupling part 14. The coupling part 14 is for connection by its screw thread 1*b* to a vacuum pump or the like. For example, when the diaphragm apparatus is used as a pressure-responsive switch of a vacuum brake system of a truck or a bus, the coupling part 14, hence the port 1*a*, is coupled to a vacuum tank T and also to a vacuum pump P of the brake system. The case 1 has a cap 2 of an insulating material, such as a plastic mold, air-tightly fixed to the case 1 by caulking the edge part of the open end 13 of the case 1. The plastic cap 2 has a tubular fixed contact 3 of a conductive material, such as brass or a contact alloy, fixed at the center thereof. A through-hole of the tubular fixed contact 3 serves as an air inlet port 3***a* of the inside space 12. A diaphragm 4 of a flexible material, such as rubber or a flexible plastic, is air-tightly mounted in the hollow space 12, being pinched with its periphery between the cylinder-shaped end part of the cap 2 and a step part 15 on the inside wall of the case 1. A moving contact 5 of a conductive material, such as brass or a contact alloy, is fixed to the center of the diaphragm 4, and its one face 58 forms a contact face which is to contact another contact face on the inside end face of the fixed contact 3. The diaphragm 4 partitions the hollow space 12 into two air-tightly divided spaces, namely a first space A connected to the through-hole 1*a* and a second space B connected to the through-hole 3*a*. The rear side of the moving contact 5 forms a spring-receiving seat 51. A compressed coil spring 6 serving as a biasing means of a conductive and resilient material, such as phospor bronze, is mounted between the spring receiver seat 51 and a spring receiver metal washer 7 fixed on a wall of the first space A.

Fixed magnetic means 8, e.g., a ring-shaped sheet comprising one or more segment permanent magnets is fixed on the peripheral part of the diaphragm 4 and to the inside wall of the case 1 by, for instance, being pinched and bonded between the end edge of the plastic cap 2 and the periphery of the diaphragm 4. Moving magnetic means 9, e.g., a ring-shaped or disk-shaped sheet comprising one or more segment permanent magnets, is mounted on the moving part, such as on the peripheral part of the moving contact 5.

As modified embodiments, the fixed magnetic means 8 and the moving magnetic means 9 may be a combination of a ring-shaped or disk-shaped sheet of one or more permanent magnets and a ring-shaped or disk-shaped sheet of one or more magnetic-force-attractable substances, respectively, or vice versa. Therefore, the moving magnetic means and the fixed magnetic means are related to each other through magnetic forces, and thereby, the pressure differential required for the rightward motion of the moving contact 5 into contact with the fixed contact 3 is much greater than that of the leftward motion of the same into the contact separated position.

The opposing faces of the fixed magnetic means 8 and the moving magnetic means 9 may have some measure of maintaining a minute air gap by, for instance, several small protrusions formed on the opposing faces or some air gap spacer, such as a coating of an appropriate non-magnetic metal film.

In the preferred embodiment of FIG. 2, the diaphragm apparatus is used as a pressure responsive switch, e.g., a vacuum brake system of a large motor car, such as a bus or a truck, and the switch circuit formed by the fixed contact 3 and the moving contact 5 is connected in series with a motor M of the vacuum pump P of the vacuum system and a power source 20.

Figure 3:
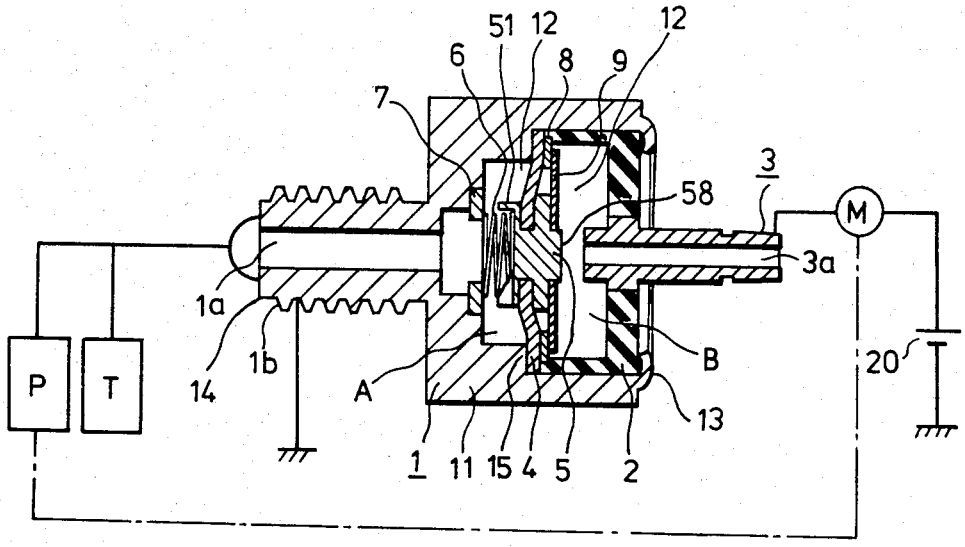
FIG. 3 is a cross-sectional side view of the embodiment of diaphragm apparatus of FIG. 2 in another state of operation.
Figure 4:
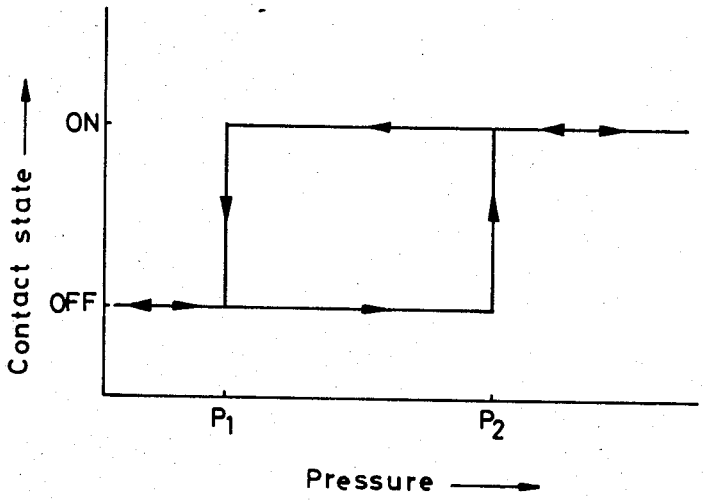
FIG. 4 is a graph showing characteristics of the operation of the apparatus shown in the embodiment of FIGS. 2 and 3.

Operation of the diaphragm apparatus embodying the present invention is described hereafter with reference to FIG. 2, which shows a state wherein the moving contact 5 is touching the fixed contact 3 thereby turning the switch ON, to FIG. 3 which shows a state wherein the moving contact 5 is separated from the fixed contact 3 thereby turning the switch OFF, and to FIG. 4 which shows the pressure-contact characteristic of the moving contact 5 against the fixed contact 3.

First, when the pressure of the vacuum tank T is sufficiently higher than a predetermined amount $P_1$ shown in FIG. 4, that is, when the difference between a low pressure of the first partition space A and an open space pressure of the second partition space B is sufficiently smaller than a predetermined pressure difference value, the diaphragm 4 is pushed rightwards by the compression spring 6, thereby causing the moving contact 5 to touch the fixed contact 3. Accordingly, the motor M of the vacuum pump P starts to drive and to evacuate the vacuum tank T.

Second, when the pressure in the vacuum tank is reduced downwards to the pressure $P_1$ of FIG. 4, that is, when the difference of the pressures of the first space A and the second space B reaches a predetermined value, the diaphragm 4 is biased to the side of the first space A by overcoming the resilient force of the spring 6. Therefore, the moving contact 5 separates from the fixed contact 3 (i.e. switching OFF), thereby deenergizing the motor M of the vacuum pump P. In this motion, as the diaphragm 4 moves to the side of the space A, the magnetic attractive force between the moving magnetic means 9 and the fixed magnetic means 8 increases at an increasing rate. At the position where the moving magnetic means 9 comes close to the fixed magnetic means, the sum of the magnetic attractive force and the force induced by the difference of the pressures between the first space A and the second space B surpasses the spring force of the spring 6. Accordingly, the moving magnetic means 9 is strongly attracted to the fixed magnetic means 8. Since generally the magnetic attractive force becomes very strong when the moving magnetic means 9 and the fixed magnetic means 8 are touching each other, a large difference in the pressures of the first space A and the second space B is required for initiating the motion of the diaphragm 4 from the position shown in FIG. 3 (where the moving magnetic means 9 contacts the fixed magnetic means 8) to the position shown in FIG. 2 (where the moving magnetic means 9 is separating from the fixed magnetic means 8). Accordingly, at the initial stage of gradual rising of the pressure of the vacuum tank T, namely that of the first space A, the diaphragm 4 is retained at the position of FIG. 3. This is because the moving magnetic means 9 is strongly attracted to the fixed magnetic means 8 and the magnetic attractive force is greater than the restoring force of the diaphragm (i.e. the difference of the force of the spring 6 and the force induced by the pressure difference of the first space A and the second space B). Then, after a considerable increase in the pressure to a higher pressure $P_2$ shown in FIG. 4 in the vacuum tank T, that is, after a considerable decrease in the difference of the pressures of the first space A and the second space B, the balance of the compression force of the spring 6 and the diaphragm pressure force surpasses the magnetic attractive force. The moving magnetic means 9 now separates from the fixed magnetic means, and the moving contact 5 moves rightwards and contacts the fixed contact 3. Thus, during increase and decrease of the pressure of the vacuum tank T, the operation of the moving contact 5 with respect to the fixed contact 3 has a hysteresis characteristic as shown in FIG. 4. This characteristic of the hysteresis curve can be adjusted by selecting different spring constants of the spring 6, the magnitude of the magnetic attractive force of the magnetic means 8,9 and the area of the diaphragm 4.

Figure 5:
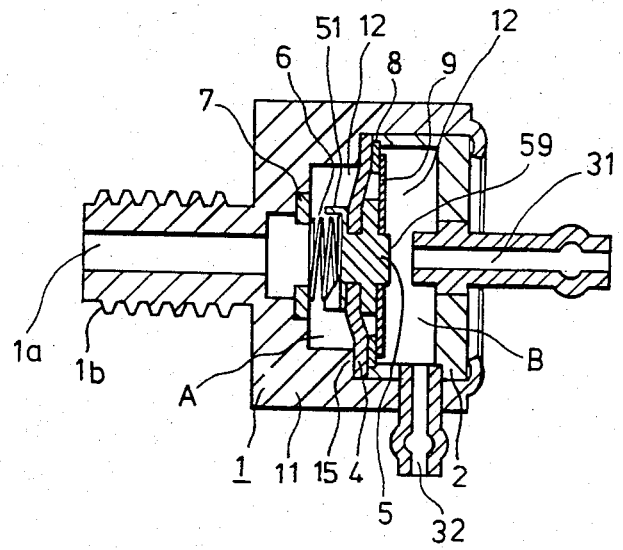
FIG. 5 is a cross-sectional side view of the exemplary diaphragm apparatus to be used as a valve for a fluid, embodying the present invention, in one state of operation.
Figure 6:
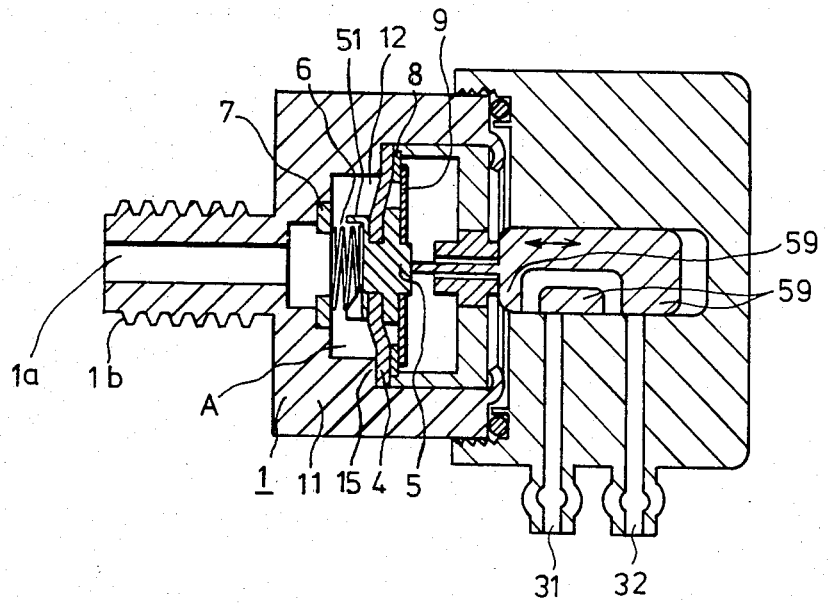
FIG. 6 is a cross-sectional side view of another example of diaphragm apparatus to be used as a valve for a fluid, embodying the present invention, in one state of operation.

As other modified embodiments, the diaphragm apparatus may be constituted as a pressure-responsive valve for controlling fluid flow by utilizing the motion of the diaphragm as shown in FIG. 5 and in FIG. 6, wherein 31 is a first fluid port, 32 is a second fluid port and 59 is a valve seat to close the first fluid port 31.

As has been described in detail for various embodiments, the diaphragm apparatus in accordance with the present invention operates the switching motions of the electric circuits or fluid circuits without an undesirable chattering phenomenon, as a result of introducing a hysteresis characteristic to diaphragm motion. Therefore, the life of the diaphragm apparatus as such, as well as of the related systems or components, can be prolonged, and so the apparatus is suitable for improved automatic control.

What is claimed is:

1. A diaphragm apparatus comprising:

a case which defines a chamber and has a first port and a second port, a diaphragm which is air-tightly mounted in said case, partitioning said chamber into two partitioned chambers, a first partitioned chamber being connected to said first port and a second partitioned chamber being connected to said second port, biasing means for biasing said diaphragm in a predetermined direction, moving magnetic means mounted movable with said diaphragm, and fixed magnetic means affixed with respect to said case, said moving magnetic means and said fixed magnetic means being thereby mutually related to each other through magnetic forces, thereby to establish a hysteresis to a pressure-position characteristic of said diaphragm for a predetermined range of positions of said diaphragm.

2. A diaphragm apparatus in accordance with claim 1, wherein said fixed magnetic means is a ring-shaped sheet of one or more permanent magnets fixed to an inside wall of said case, and said moving magnetic means is a disk-shaped sheet of one or more permanent magnets mounted on a moving part of said diaphragm.

3. A diaphragm apparatus in accordance with claim 1, wherein:

said fixed magnetic means is a ring-shaped sheet of one or more permanent magnets fixed to inside wall of said case, and said moving magnetic means is a disk-shaped sheet of a magnetic-force-attractable substance.

4. A diaphragm apparatus in accordance with claim 1, wherein:

said fixed magnetic means is a ring-shaped sheet of one or more magnetic-force-attractable substances fixed to inside wall of said case, and said moving magnetic means is a disk-shaped sheet of one or more permanent magnets.

5. A diaphragm apparatus in accordance with claim 1, wherein:

said biasing means is a coil spring of a resilient and conductive substance.

6. A diaphragm apparatus in accordance with claim 1, wherein:

a moving contact is provided on said diaphragm, a fixed contact is provided on a fixed structural part of said case, and said moving contact and said fixed contact constitute a switch.

7. A diaphragm apparatus in accordance with claim 1, wherein:

a fixed valve port is fixed to said case and a moving valve seat is adapted to be driven by a motion of said diaphragm and to establish valve control action with respect to said fixed valve port.

8. Pressure sensitive electrical switching apparatus comprising:

a case having first and second ports, a diaphragm means mounted air tightly within the case for activating and deactivating a switch, said diaphragm means partitioning the case into two chambers respectively connected to said first and second ports, and spring biasing means for biasing said diaphragm means in a first direction, said spring biasing means fixed to said case at one end thereof and to said diaphragm means at another end thereof, said diaphragm means fixed at one area thereof to said case and having a movable area, first and second magnetic means connected to said diaphragm means, said first magnetic means connected to said movable area of said diaphragm means and said second magnetic means connected to said fixed area of said diaphragm means for providing additional force opposing said spring biasing means, thereby establishing a hysteresis in a pressure-position characteristic of said pressure sensitive electrical switching apparatus for a predetermined range of positions of said diaphragm means.

9. Pressure sensitive electrical switching apparatus as recited in claim 8 wherein said fixed area of said diaphragm means comprises a peripheral portion thereof.

10. Pressure sensitive electrical switching apparatus as recited in claim 8 wherein said first and second magnetic means are mounted on a single side of said diaphragm means.

11. Pressure sensitive electrical switching apparatus as recited in claim 8 wherein said first and second magnetic means are arranged to provide attractive magnetic forces.

12. Pressure sensitive electrical switching apparatus as recited in claim 8 wherein a movable contact of said switch is directly mounted on the movable area of said diaphragm means for movement therewith, and a fixed contact of said switch is mounted to said case.

13. Pressure sensitive electrical switching apparatus comprising:

a case having first and second ports, a diaphragm means mounted air tightly within the case for activating and deactivating a switch, said diaphragm means partitioning the case into two chambers respectively connected to said first and second ports, and spring biasing means for biasing said diaphragm means in a first direction, said spring biasing means fixed to said case at one end and to said diaphragm means at another end thereof, said diaphragm means fixed at a peripheral area thereof to said case and having a movable area, said switch including movable and fixed contacts connected to said movable area and to said fixed area of said diaphragm, respectively, and means for providing hysteresis to a pressure-position characteristic of said contacts comprising first and second magnetic means connected to said movable and fixed contacts of said switch to provide additional force acting concurrently with force exerted by said spring biasing means, thereby to establish said hysteresis in movement of said contacts.

* * * * *